United States Patent [19]

Cottam

[11] Patent Number: 4,531,253

[45] Date of Patent: Jul. 30, 1985

[54] CLEANING DEVICE

[76] Inventor: Spencer D. Cottam, 11210 Cypress Way Dr., Houston, Tex. 77065

[21] Appl. No.: 513,695

[22] Filed: Jul. 14, 1983

[51] Int. Cl.[3] ..... A47L 13/08

[52] U.S. Cl. ..... 15/236 C; 15/93 R; 30/172; 30/350

[58] Field of Search ..... 15/93 R, 236 C; 299/41, 299/39; 175/379; 30/172, 350

[56] References Cited

U.S. PATENT DOCUMENTS

| | | | |
|---|---|---|---|
| 1,607,083 | 11/1926 | Ignatieff | 30/350 |
| 1,786,096 | 12/1930 | Thielmann | 15/93 R |
| 2,480,739 | 8/1949 | Johnson | 15/93 R |
| 2,504,643 | 4/1950 | Burgoon | 15/93 R |
| 2,565,047 | 8/1951 | Rowland | 15/93 R |
| 3,049,739 | 8/1962 | Lantto | 30/172 |
| 4,106,193 | 8/1978 | Fisher et al. | 15/93 R |
| 4,148,110 | 4/1979 | Moen | 15/236 C |
| 4,385,412 | 5/1983 | Neufeldt | 15/93 R |

FOREIGN PATENT DOCUMENTS

| | | | |
|---|---|---|---|
| 1041386 | 10/1958 | Fed. Rep. of Germany | 15/93 R |
| 0312704 | 11/1933 | Italy | 15/93 R |

*Primary Examiner*—Chris K. Moore

*Attorney, Agent, or Firm*—Pravel, Gambrell, Hewitt & Kimball

[57] ABSTRACT

A cleaning apparatus for contacting a surface to be cleaned comprising a plurality of bent wires mounted with a resilient mounting member and adapted to be moved to a cutting position when the mounting member is rotated or otherwise moved relative to the surface to be cleaned.

11 Claims, 5 Drawing Figures

Fig. 1
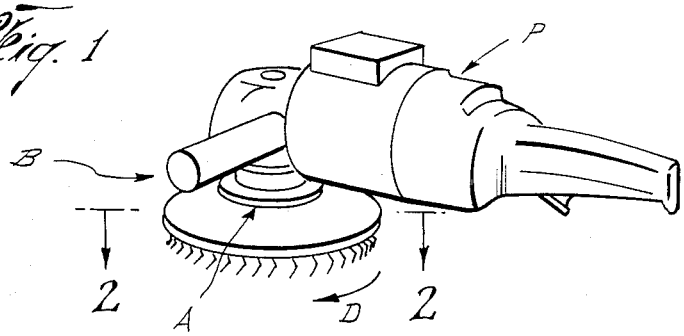
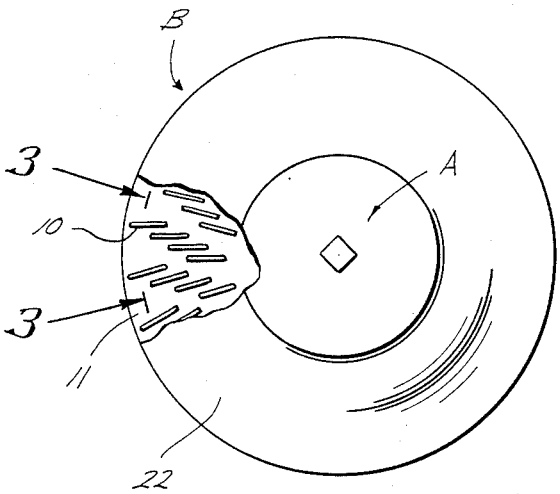
Fig. 2
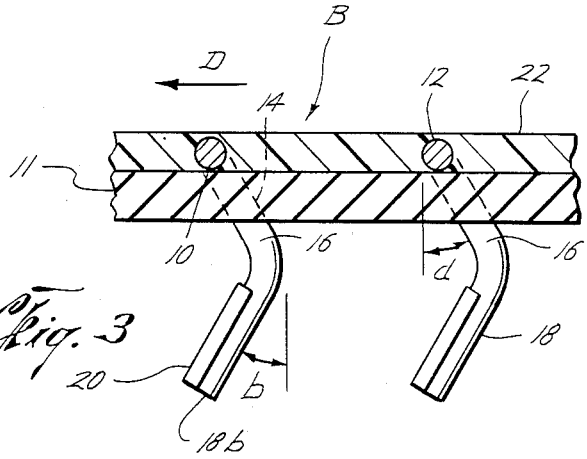
Fig. 3
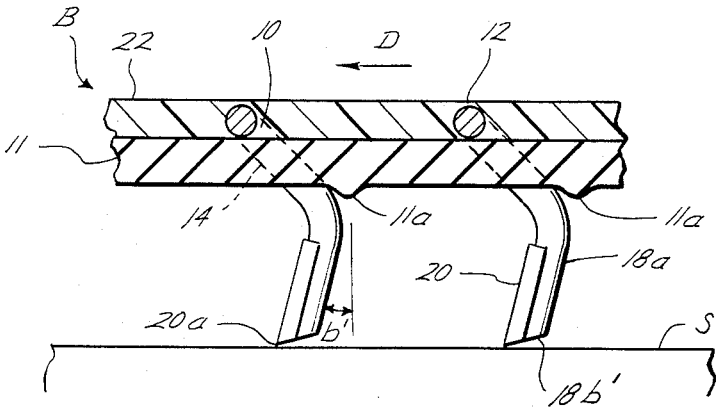
Fig. 4

CLEANING DEVICE

FIELD OF THE INVENTION

The field of this invention relates generally to cleaning devices for contacting a surface to be cleaned.

BACKGROUND OF THE INVENTION

It is known in the field of carding devices to utilize wire clips mounted in closely set rows in various belting materials fastened to a backing for carding fibers. However, such carding devices are not used in grinding or contacting a surface to remove rust, paint, etc. Further the wires in such carding devices do not include the use of a wear resistant coating.

Wire brushes are presently used to abrade a surface. Generally, such wire brushes have a plurality of wires mounted with a rigid frame and the wires mounted therein are designed to flex in response to the abrasive action between the surface and the wire brush such that the wire drags across the surface to be cleaned.

SUMMARY OF THE INVENTION

The cleaning device of the present invention includes a plurality of bent wires mounted in a resilient member. The resilient member may be further adapted for connection with a drive unit to drive both the resilient member and the bent wires relative to a surface to be cleaned. During such movement the engagement of the bent wires with the surface to be cleaned causes the leading edge of each bent wire to be directed toward the direction of movement of the mounting member.

In the present invention, fatigue failures of the wires are reduced because the resilient member permits a pivoting type movement of the bent wires in the resilient mounting member. As such, a stiffer wire can be utilized to effect more rapid cleaning of a surface. Moreover, the wire retains a leading angle with respect to the direction of abrasion such that the wire contacts the surface in a cutting configuration and not in a trailing configuration unlike wire brushes where the cutting action is obtained by dragging the wire across the surface to be cleaned.

BRIEF DESCRIPTION OF THE DRAWINGS

FIG. 1 is a perspective view of the cleaning device mounted with a rotary drive unit;

FIG. 2 is a partially cut away plan view of the cleaning device looking along lines 2—2 in FIG. 1;

FIG. 3 is a view, partly in section, of the cleaning device looking along line 3—3 in FIG. 2 showing one embodiment of two of the bent wires prior to contact with a surface to be cleaned;

FIG. 4 is a view, partly in section, of the apparatus in FIG. 3 showing the displacement of the wires during contact with a surface to be cleaned.

DESCRIPTION OF THE PREFERRED EMBODIMENT

Figure 5:
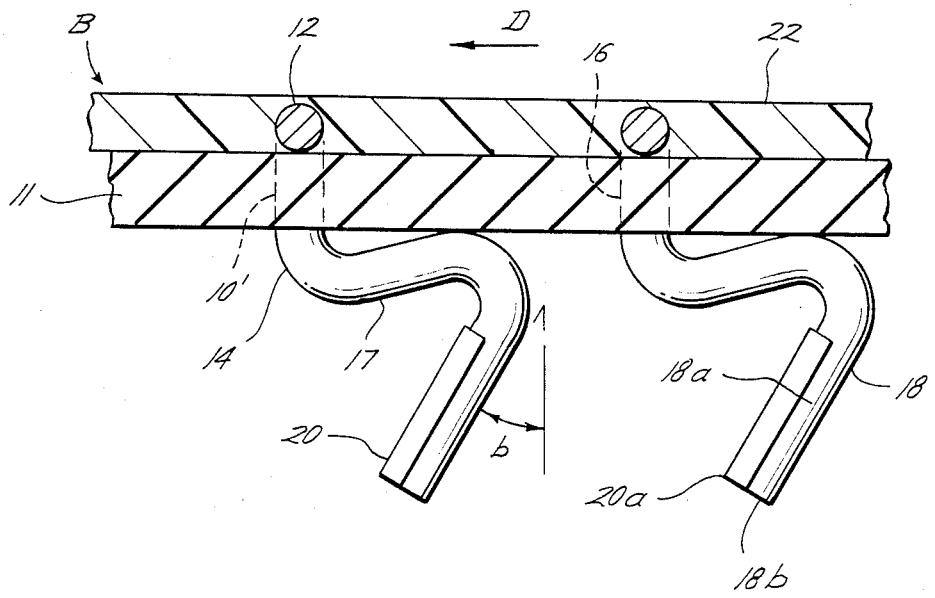
FIG. 5 is a partially sectional view of the cleaning device looking along line 3—3 of FIG. 2 showing a second embodiment of the bent wires.

In FIGS. 1-5, the cleaning device of the present invention is generally designated by the letter B. The cleaning device B includes a plurality of bent wires 10 mounted in a resilient mounting member 11.

Each of the bent wires 10 has a crown portion 12 and a pair of elongated pins 14 integrally attached thereto extending substantially perpendicular in a downward direction from the crown portion 12. In a first embodiment of the bent wires 10 shown in FIGS. 3 and 4, the crown portion 12 is mounted on the upper surface of resilient mounting member 11 and the elongated pins 14 extend downwardly through the resilient mounting member 11. Each of the elongated pins 14 has a first portion 16 which is angularly disposed within the resilient mounting member 11 in a rearward direction with respect to the direction of rotation or movement of the mounting member 11. The inclined first portion 16 preferably makes an angle d, with a perpendicular drawn to the surface of resilient member 11. The angle d is preferably about 30°. Integrally attached with the first portion 16 is a second portion 18 which is formed relative to the first portion 16 such that it makes an angle b with a perpendicular drawn to the surface of resilient mounting member 11. The second angle b is preferably about 30°.

As will be discussed more in detail later, the direction of movement for the cleaning device B is shown in FIGS. 3 and 4 by the arrow D. Relative to the direction of arrow D, the first portion 16 is mounted in a substantially trailing direction or away from the direction of rotation of mounting member 11. The second portion 18 is deformed in a leading direction or toward the direction of rotation of the mounting member 11.

Each of the bent wires 10 preferably includes a wear resistant coating 20 which is fixed to the leading edge 18*a* of the second portion 18. Such wear resistant coating 20 is preferably tungsten carbide, although those skilled in the art will appreciate that other wear resistant coatings can be used.

With the bent wires 10 mounted in resilient mounting member 11, a resilient coating 22 is bonded by any suitable means or is otherwise attached to the resilient member 11 with the crown portion 12 of each bent wire 10 embedded therein. Such resilient coating 22 cooperates with resilient mounting member 11 in keeping the bent wires 10 attached to the resilient member 11. The resilient coating 22 is preferably a layer of rubber material is bonded to the bent wires 10 and the resilient mounting member 11.

In the embodiment shown, the cleaning device B is adapted for mounting with conventional rotating power tools. For example, as shown in FIGS. 1 and 2, the cleaning device B includes a conventional mounting means A for releasably connecting the cleaning device B to a rotary power tool P.

The resilient mounting member 11 shown in FIGS. 1 and 2 is preferably in the form of a rubber disc with wire reinforcements. Alternative embodiments of the cleaning device B are also comprehended and would include a cleaning device in which the resilient mounting member 11 is an endless belt (not shown) which is suitable for continuous endless movement with a conventional power drive unit.

Looking at FIG. 4, the cleaning device B of the present invention is shown during contact with the surface S for the purpose of cleaning the surface by removing rust, paint or the like from such surface S. As the cleaning device B rotates in the direction shown by arrow D and bent wires 10 contact surface S, a bending moment is generated tending to pivot the bent wires 10 from the position shown in FIG. 3 to that shown in FIG. 4. Such rotation or pivoting is possible because resilient member 11 permits bent wires 10 to pivot in response to the bending moment without any significant flexing of the bent wires 10. Responsive to the rotation of bent wires 10, resilient mounting member 11 flexes to form bulge 11*a* and thereby resists further rearward pivoting of bent wires 10. As bent wire 10 rotates, a downward vector acts upon the crown portion 12 to force it into the resilient mounting member 11 so as to retain the bent wire 10 from being pushed upwardly and out of the resilient mounting member 11.

The bent wires 10 have moved from the position shown in FIG. 3 (angle b) to the position shown in FIG. 4 (angle b'). Angle b' is approximately 15° and allows the bent wires 10 to cut like a knife or machine tool rather than drag like a wire brush across the surface S.

Since the bent wires 10 do not bend or flex appreciably when they contact the work surface S, failures due to fatigue and breakage caused by repeated flexing of the bent wires 10, as would be encountered with a common wire brush, are eliminated. As such, stronger, stiffer wires 10 can be used since most of the flexing occurs within the resilient means 11 and not the bent wires 10 themselves.

The thin coating of tungsten carbide 20 placed on the leading edge 18*a* of each of the wires 10 provides a wear resistant cutting edge 20*a*. The bent wire 10 is generally made of spring steel and is less wear resistant than the coating 20. Hence lower surface 18*b* of bent wires 10 is constantly worn away when it engages surface S so as to continually provide a sharp cutting edge 20*a*. Cutting edge 20*a* is thus self sharpening due to the differential wear between the tungsten carbide coating 20 and bent wire 10. Depending upon the surface finish desired on the surface S, various gauges of bent wires 10 can be used. For example, smaller diameter bent wires 10 can be utilized to achieve a finer finish or higher degree of polish. By altering the angles b and d of the bent wires 10 or the stiffness of resilient mounting member 11, a textured surface pattern can be imparted to surface S which is desirable for good paint adhesion.

In use, the cleaning device B is operated to remove rust, paint as well as other undesirable surface conditions. As the cleaning device B moves the bent wires 10 relative to the surface S, the flat end surface 18*b* resistively engages the surface S. Because of the resistive engagement of surfaces S, the bending movement tends to rotate the bent wire 10 from angle b to b' and a portion of lower end surface 18*b* is worn away to form an angled lower end surface 18*b'*, as seen in FIG. 4, so as to provide the self sharpening cutting edge 20*a*.

A second embodiment of the bent wires 10' is shown in FIG. 5. The first portion 16 of pin 14 is mounted substantially upright in the resilient member 11 such that angle d is 0°. The elongated pins 14 include a substantially horizontal interconnecting portion 17 integrally formed between the first portion 16 and the second portion 18. The interconnecting portion 17 is positioned substantially parallel to the surface of resilient mounting member 11. The second portion 18 is deformed relative to the resilient mounting member 11 by the angle b as previously discussed.

The second embodiment of bent wire 10' rotates in substantially the same manner as the first embodiment of bent wire 10 in response to the bending movement generated by the relative motion shown by arrow D. However, in response to an upward vertical force on bent wire 10', substantially all of such force is translated into a rotating or pivoting movement on bent wire 10' tending to draw the crown portion 12 further into resilient mounting member 11 and compress interconnecting portion 17 into resilient mounting member 11. As such, the ejection of the bent wires 10' out of resilient mounting member 11 due to a vertically upward force is substantially eliminated. Therefore, resilient coating 22 is not necessary with second embodiment of bent wire 10' to resist ejection of bent wires 10' from resilient mounting member 11 but may be optionally added as shown in FIG. 5.

The foregoing disclosure and description of the invention are illustrative and explanatory thereof, and various changes in the size, shape and materials, as well as in the details of the illustrated construction may be made without departing from the spirit of the invention.

I claim:

1. A cleaning device for use with a drive unit for contacting a surface to be cleaned comprising:

a plurality of bent wires, each wire having a crown portion and a pair of elongated pins extending substantially perpendicular in a downward direction from said crown portion;

a resilient mounting member receiving each of said bent wires with the crown portion on the upper surface of said member and with said elongated pins extending through said resilient mounting member, said elongated pins having a first portion angularly disposed to the surface plane of said resilient mounting member and substantially within said resilient mounting member and an integrally connected second portion formed at an opposite angle relative to said first portion; and means cooperating with said mounting member for releasably attaching said device to a drive unit to impart movement to said wires relative to the surface to be cleaned, whereby, upon rotation of said device in a predetermined direction, impact between said second portion and said surface to be cleaned is caused, and said resilient mounting member exerts a downward force on said first portion, causing a reaction force to be exerted on each of said crown portions in a direction towards and substantially perpendicular to the upper surface of the resilient mounting member.

2. The cleaning device of claim 1, further including:

a wear resistant coating being fixed on the second portion of said elongated pins.

3. The cleaning device of claim 2, wherein:

said bent wires are of a less wear resistant material than said wear resistant coating such that said bent wire has a self sharpening cutting edge.

4. The cleaning device of claim 1, wherein:

the first portion of said elongated pins being formed away from the direction of movement of the resilient mounting member when it is driven by a drive unit.

5. The cleaning device of claim 1, wherein:

the second portion of said elongated pins being formed towards the direction of movement of the resilient mounting member when it is drive by a drive unit.

6. The cleaning device of claim 1, wherein:

said resilient mounting member is a disc adapted for rotary movement.

7. The cleaning device of claim 1, further including:

a rubber material bonded with said resilient mounting member being adapted to retain said bent wires in said resilient mounting member.

8. A cleaning device for use with a drive unit for contacting a surface to be cleaned comprising:

a plurality of bent wires, each wire having a crown portion and a pair of elongated pins extending substantially perpendicular in a downward direction from said crown portion;

a resilient mounting member receiving each of said bent wires with the crown portion on the upper surface of said member and with said elongated pins extending through the resilient mounting member;

said elongated pins having a first portion disposed within said resilient mounting member in a substantially perpendicular direction from said mounting member, an integrally connected intermediate portion, said intermediate portion being positioned substantially parallel with said resilient mounting member, and a second portion formed at an angle relative to said first portion, whereupon impact between said second portion and the surface to be cleaned, said intermediate portion contacts said resilient mounting member whereupon said resilient mounting member exerts a downward force independently on each said intermediate portion in a direction substantially perpendicular to the surface to be cleaned; and means with said mounting member for releasably attaching to a drive unit to impart movement to said wires relative to the surface to be cleaned.

9. The cleaning device of claim 8 wherein:

said first portion of said elongated pins is disposed at a slight angle to the perpendicular to the surface plane of said resilient mounting member and substantially within said resilient mounting member.

10. The cleaning device of claim 8 further including:

a rubber material bonded with said resilient mounting member being adapted to retain said bent wires in said resilient mounting member.

11. The cleaning device of claim 8 wherein:

said resilient mounting member is a disc adapted for rotary movement.

* * * * *